US011097138B2

(12) United States Patent
Hut

(10) Patent No.: US 11,097,138 B2
(45) Date of Patent: Aug. 24, 2021

(54) RETRACTING DEVICE WITH HOSE GUIDE FOR RETRACTING A HOSE, VEHICLE PROVIDED THEREWITH AND METHOD THEREFOR

(71) Applicant: HYTRANS BEHEER B.V., Lemmer (NL)

(72) Inventor: Robert Dirk Hut, Lemmer (NL)

(73) Assignee: HYTRANS BEHEER B.V., Lemmer (NL)

( * ) Notice: Subject to any disclaimer, the term of this patent is extended or adjusted under 35 U.S.C. 154(b) by 356 days.

(21) Appl. No.: 16/306,964

(22) PCT Filed: Jun. 12, 2017

(86) PCT No.: PCT/NL2017/050388

§ 371 (c)(1),
(2) Date: Dec. 4, 2018

(87) PCT Pub. No.: WO2017/217841

PCT Pub. Date: Dec. 21, 2017

(65) Prior Publication Data

US 2019/0134441 A1 May 9, 2019

(30) Foreign Application Priority Data

Jun. 13, 2016 (NL) ..... 2016951

(51) Int. Cl.
*A62C 33/02* (2006.01)
*B65H 54/78* (2006.01)
(Continued)

(52) U.S. Cl.
CPC ..... *A62C 33/02* (2013.01); *B65H 54/00* (2013.01); *B65H 54/78* (2013.01); *B65H 57/006* (2013.01);
(Continued)

(58) Field of Classification Search
None
See application file for complete search history.

(56) References Cited

U.S. PATENT DOCUMENTS 3,601,038 A * 8/1971 Hayes ..... A62C 27/00 100/100
3,866,532 A * 2/1975 Ogden, Jr. ..... A62C 33/02 100/171

(Continued)

FOREIGN PATENT DOCUMENTS

CN 201361392 Y 12/2009
CN 203647926 U 6/2014

(Continued)

OTHER PUBLICATIONS

International Search Report and Written Opinion from PCT/NL2017/050388 dated Sep. 18, 2017 pp. 13.

*Primary Examiner* — William A. Rivera
(74) *Attorney, Agent, or Firm* — Kacvinsky Daisak Bluni PLLC

(57) ABSTRACT

A retracting device, vehicle provided therewith and method for retracting a hose. The retracting device includes a frame, a retraction drive connected to the frame for retracting the hose, a coupling configured to couple the frame to a container, and a displacement drive configured to displace the frame relative to the container such that the retracted hose can be placed in the container. The retracting device further includes a hose guide configured to guide the hose for retraction to the retraction drive, and the hose guide is displaceable in operative connection to the frame.

19 Claims, 3 Drawing Sheets

Figure 1A:
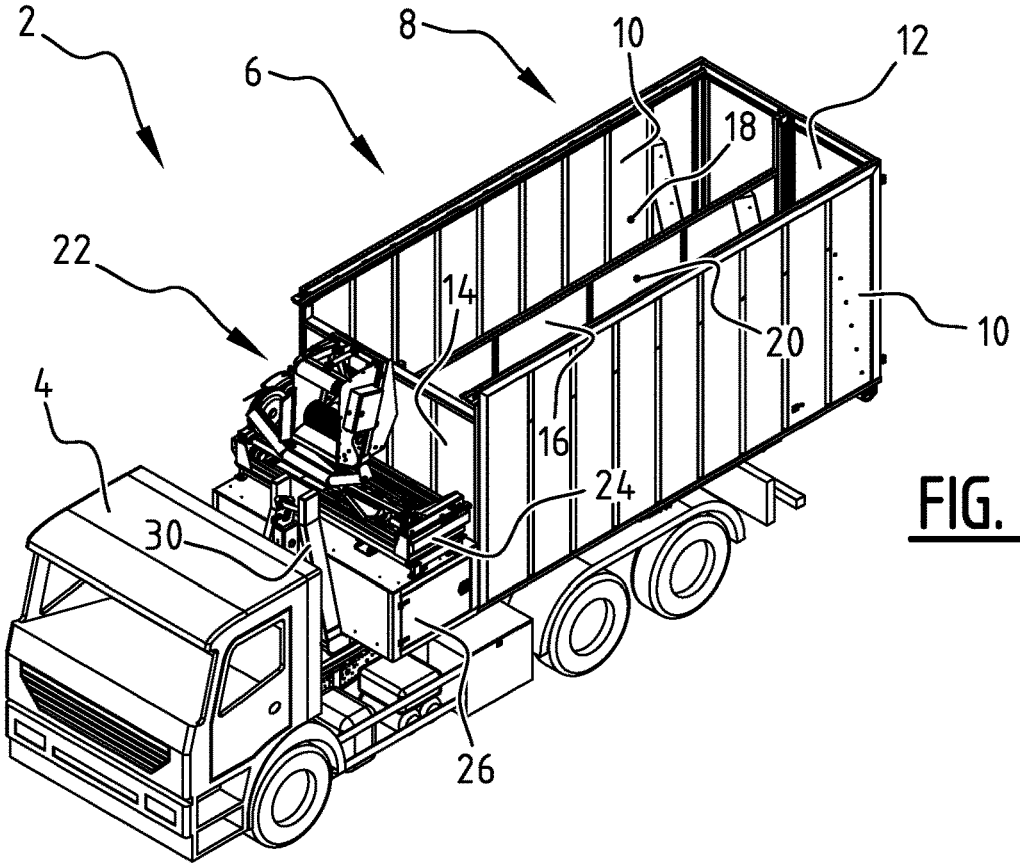

(51) Int. Cl.
*B65H 57/00* (2006.01)
*B65H 75/36* (2006.01)
*B65H 54/00* (2006.01)

(52) U.S. Cl.
CPC ..... *B65H 75/362* (2013.01); *B65H 2701/33* (2013.01)

(56) References Cited

U.S. PATENT DOCUMENTS 5,040,259 A * 8/1991 Ishii ..... A62C 33/02 15/40
5,636,648 A * 6/1997 O'Brien ..... B08B 9/04 134/107
8,376,202 B2 * 2/2013 Baker ..... B65H 51/32 226/1
9,399,560 B2 * 7/2016 Baker ..... A62C 33/00
10,132,426 B2 * 11/2018 Baker ..... B65H 54/28
2003/0230210 A1 * 12/2003 Porat ..... B41F 7/02 101/486
2005/0011979 A1 * 1/2005 Best ..... A62C 33/02 242/370
2006/0207659 A1 * 9/2006 Shaefer ..... F04B 23/04 137/355.2
2014/0197219 A1 * 7/2014 Baker ..... F16L 1/065 226/186
2015/0021373 A1 * 1/2015 Baker ..... F16L 1/065 226/186
2015/0041515 A1 * 2/2015 Hut ..... A62C 33/02 226/176
2016/0257526 A1 * 9/2016 Sander ..... B05B 15/62
2017/0342700 A1 * 11/2017 Wiedemann ..... B65H 57/14

FOREIGN PATENT DOCUMENTS

GB 2129462 A * 5/1984 ..... B65H 54/78
GB 2129462 A 5/1984
JP H08299490 A 11/1996
WO 2013095116 A2 6/2013

* cited by examiner

RETRACTING DEVICE WITH HOSE GUIDE FOR RETRACTING A HOSE, VEHICLE PROVIDED THEREWITH AND METHOD THEREFOR

This is a national stage application filed under 35 U.S.C. § 371 of pending international application PCT/NL2017/050388 filed Jun. 12, 2017, which claims priority to Netherlands Patent application NL 2016951, filed Jun. 13, 2016, the entirety of which applications are hereby incorporated by reference herein.

The present invention relates to a retracting device for retracting a hose. Such a hose is particularly a fire hose or other liquid hose. After a fire has been extinguished, or after a different use, these hoses are retracted with the retracting device according to the invention.

A hose retracting device known in practice is for instance described in NL 9301097. This describes a retracting device whereby it is possible to pull a hose upward from a ground surface. An alternative retracting device is for instance described in NL 2007956, wherein a retracting device is provided with a frame, a drive roller and two pressing elements, wherein no more than one pressing element presses against the drive roller during use. Such a device is for instance particularly suitable for retracting fire hoses wherein individual hose parts are connected with a hose coupling.

A problem with retracting devices known in practice is that the hose must also be positioned in a container in desired manner after being picked up. Such a container is for instance a receptacle or bin. The hose is here usually positioned manually. This manual positioning is labour-intensive. In a retracting device which is placed on a vehicle this positioning is further performed during travel. This forms a safety risk.

The present invention has for its object to provide an improved retracting device with which the above stated drawbacks are obviated and at least reduced, such that safe and effective retraction of a hose is possible. This objective is achieved with a retracting device for retracting a hose according to the invention, the retracting device comprising:

- a frame;
- a retraction drive, connected to the frame, for retracting the hose;
- a coupling configured to couple the frame to a container, and a displacement drive configured to displace the frame relative to the container such that the retracted hose can be placed in the container; and
- a hose guide configured to guide the hose for retraction to the retraction drive, wherein the hose guide is displaceable in operative connection to the frame.

The retracting device according to the invention serves particularly for retracting a hose, such as a fire hose or other liquid hose, wherein individual hose parts are usually connected to each other with hose couplings.

The retraction drive provides the option of driving, and thereby pulling up from a ground surface, the hose to be retracted. This avoids the necessity of manual pulling on the hose for retraction. It should be noted here that for instance a fire hose can usually be wholly or partially filled with water following use, so that picking up these hoses requires a not inconsiderable force. The retraction drive enables picking up and, with this, retraction of the hoses. The retracting device is here in a currently preferred embodiment provided with a drive roller and one or more pressing elements which are configured to retract the hose in co-action with the drive roller. In this embodiment the drive roller is embodied as a cylindrical element over which the hose for retraction is guided. The drive roller is preferably driven by a motor in order to be able to exert the required force. Such an embodiment is for instance described in NL 2007956.

According to the invention, the retraction drive is connected to the frame. The frame can be coupled to a container, for instance in the form of a receptacle or bin, by providing a coupling. The coupling can thus for instance be activated as soon as a hose has to be retracted, such that the frame is operatively connected to the container. A displacement drive achieves that the frame is displaceable relative to the container, such that the retracted hose can be placed in the container at a desired position during use. The frame moves here over a large part of the plane of the container. In a currently preferred embodiment the frame moves particularly over the upper edge of the container. A good positioning of the retracted hose over the whole available volume of the container is hereby achieved. This also minimizes the amount of manual labour during retraction of a hose. In addition, no persons need be present in the container for the purpose of positioning the retracted hose. This improves the safety of retraction of a hose.

The retraction drive here provides for the picking up of the hose for retraction from the ground surface, and the movement of the frame relative to the container enables a positioning of the hose in the container at a desired position. It is possible here to have the frame follow a desired pattern, such that the hose is for instance carried into the container in loops. Other patterns are also expressly possible.

The frame is preferably provided with a guide for displacing the retraction drive relative to the frame. Displacing the retraction drive relative to the frame using the guide provides an additional movement option of the retracting device relative to the container. Displacing the frame relative to the container and enabling the retracting device to be moved over the frame achieves that the picked-up hose can be laid over substantially the whole area of the container using the retracting device. In a currently preferred embodiment the frame is displaced in longitudinal direction of the container. In this embodiment the longitudinal direction of the container usually corresponds to a direction parallel to the direction of travel of the vehicle provided with a retracting device according to the invention. In such a currently preferred embodiment the retracting device moves in transverse direction relative to the frame. In this embodiment the transverse direction substantially corresponds to a direction at right angles to the longitudinal direction and preferably also at right angles to the direction of travel of the vehicle provided with the retracting device. The space of the container is hereby used in the most optimal possible manner, such that an optimal amount of hose can be carried into a container. A retracted hose can hereby be transported and/or stored in optimal manner.

Operatively connecting the hose guide according to embodiments of the invention to the frame enables them to be placed in mutual co-action according to the invention. The position of the hose guide can thus be adjusted to the current position and movement of the retracting device relative to the container. This achieves an effective retracting process. When the retracting device moves counter to the direction of travel, i.e. rearward relative to the container during movement of the vehicle which is provided with a container and a retracting device according to the invention, the hose guide will thus in a possible embodiment for instance likewise co-displace in the rearward direction. If desired, the speed of the vehicle can here be increased in order to keep the pick-up speed of the hose as constant as possible. In opposite direction of the frame relative to the container, i.e. the frame moving forward relative to the container, the speed of the vehicle can likewise be adjusted such that this speed is reduced in order to thereby once again keep the pick-up speed of the hose as constant as possible. In such an embodiment the speed of the vehicle is therefore adjusted, such that the speed of the retracting device and the hose guide operatively connected thereto remains as constant as possible relative to the ground surface. This achieves that the most constant possible retracting speed of the hose is realized. This provides for a smooth retracting process and controllable positioning of the retracted hose in the container.

In an advantageous preferred embodiment according to the invention the frame is further provided with a lifting system configured to move the frame between a transport position and a retracting position.

Providing a lifting system enables the frame to be moved in effective manner between a transport position and a position of use or retracting position. A reasonable working height is required because in a position of use/retracting position the frame usually moves on the upper side of the container. Providing a lifting system achieves that the transport height, also referred to as the headroom of a vehicle provided with a retracting device according to the invention, can remain limited because the lifting system preferably lowers the retracting device to the transport position when not in use.

In a currently preferred embodiment the lifting system is provided on the front side, as seen in the direction of movement of a container arranged on a vehicle, so that the retracting device can be transported together with the container in effective manner. A start of the hose is preferably carried into the retracting device at the start of the retraction of the hose. This is preferably performed at an effective working height, after which the retracting device is carried to the retracting position with the lifting system. Retraction of a hose can hereby be started in effective manner. A user is for instance prevented here from having to climb into or onto a container to be able to start the retraction of the hose. This increases the safety further still.

The lifting system preferably comprises a scissor mechanism. Providing a scissor mechanism enables the lifting mechanism to be provided in a relatively limited space, such that efficient transport of the lifting system with retracting device is possible.

In an advantageous preferred embodiment according to the invention the coupling for coupling the frame to a container comprises a toothing.

By providing a toothing in the coupling the frame can be coupled displaceably to the container in effective manner. In a currently preferred embodiment an upper edge of the container is likewise provided here with a guide, preferably also in the form of a toothing. By having the guide with the preferred toothing of the frame connect to the guide of the container, the frame can be displaced relative to the container in effective manner via for instance a gear rack mechanism. It will be apparent that it is also possible to apply alternative mechanisms. In a currently preferred embodiment the guide of the frame is also provided with a toothing according to a similar principle for the purpose of displacing the retraction drive relative thereto. The frame can hereby be displaced relative to the container, and the retraction drive relative to the frame, in effective manner.

The coupling is preferably further provided with a locking pawl. By providing such a locking pawl a robust connection between the frame and the container can be brought about, for instance with a pin-hole connection. The frame is here preferably moved upward from the transport position with the lifting system and taken into use at the retracting position. A stable coupling is obtained in this manner.

In a further advantageous preferred embodiment according to the invention the hose guide is fixedly connected to the frame.

By connecting the hose guide fixedly to the frame a movement of the retracting device with the frame can be combined in co-action with the movement of the hose guide in effective manner. In this way the hose guide follows the retracting device, at least in the movement of the frame relative to the container.

In a further advantageous preferred embodiment according to the invention the retracting device further comprises a rotation mechanism for rotating the retraction drive relative to the frame.

Providing a rotation mechanism, for instance embodied as a rotation shaft with a drive cylinder, achieves that the orientation of the retracting device is adjusted to the current position relative to the container and the hose for retraction. If the hose guide is arranged on a side of the container and there co-displaces in longitudinal direction along with the position of the frame on the retracting device, the orientation, particularly the angle, of the retracting device with the direction of travel can thus for instance be adjusted when the retracting device moves in transverse direction. This provides an optimal retracting process wherein the number of disruptions can be reduced.

The invention further relates to a vehicle provided with a retracting device as described above and a container for storing the retracted hose.

Such a vehicle provides the same effects and advantages as described in respect of the retracting device. Such a vehicle is particularly a fire engine vehicle with which a used hose is retracted and thereby cleared away after use. The container is for instance a loading space of the vehicle. The displacement drive of the retracting device for instance makes use of the combustion engine or battery of the vehicle. A separate drive of the retracting device is otherwise also possible. The container which is arranged fixedly or removably on the vehicle is preferably provided with a guide for displacing the frame relative to the container using the displacement drive. This enables an effective displacement.

The invention further also relates to a method for retracting a hose, comprising of:

providing a retracting device and/or vehicle as described above; and retracting the hose with the retracting device.

Such a method provides the same effects and advantages as stated in respect of the retracting device and/or the vehicle.

The method preferably further comprises of moving the retracting device from a transport position to a retracting position when starting up the retraction of a hose. The start of the hose for retraction is here preferably also introduced into the retracting device prior to moving the retracting device to a complete retracting position. It is thus for instance possible to displace the lifting system in the retracting device from the transport position over a certain distance, so that the hose can be introduced in effective manner, after which the retracting device is carried to the desired retracting position. During retraction of the hose the retracting device is preferably moved relative to the container such that a determined folding pattern is followed, along which the hose is carried into the container. The hose can hereby be carried into the container in stable manner, for instance with a loop form in a specific pattern.

Figure 1B:
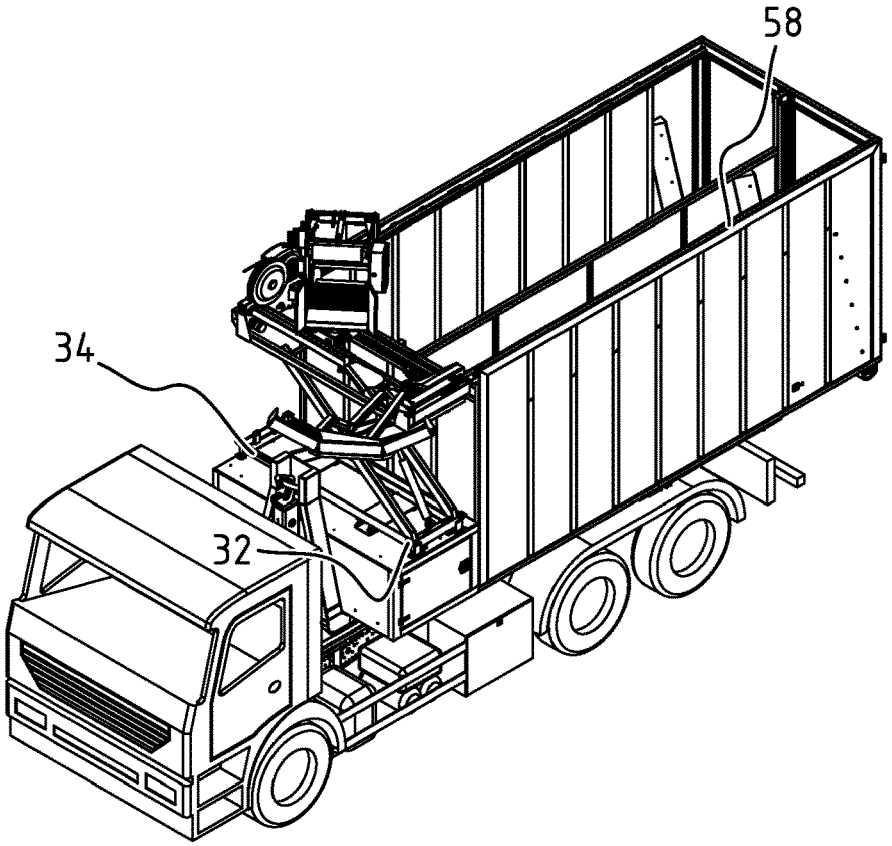
Figure 1C:
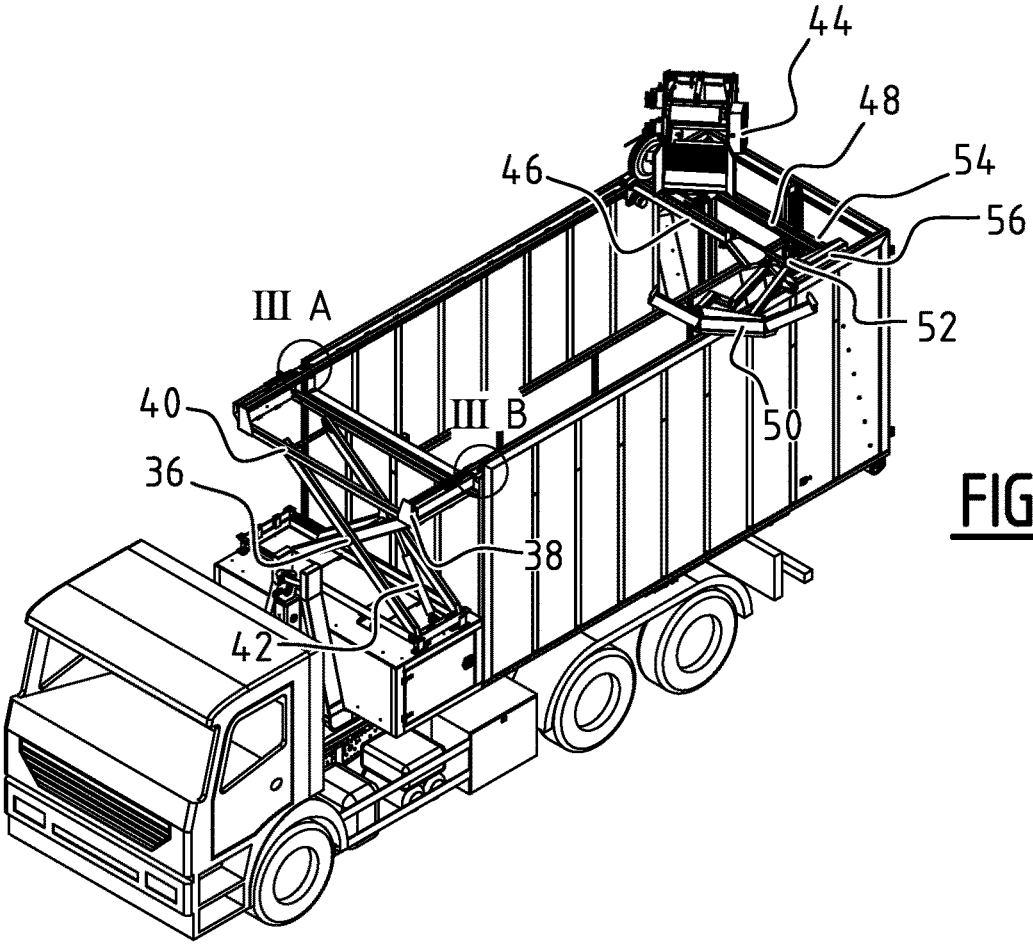
Figure 2A:
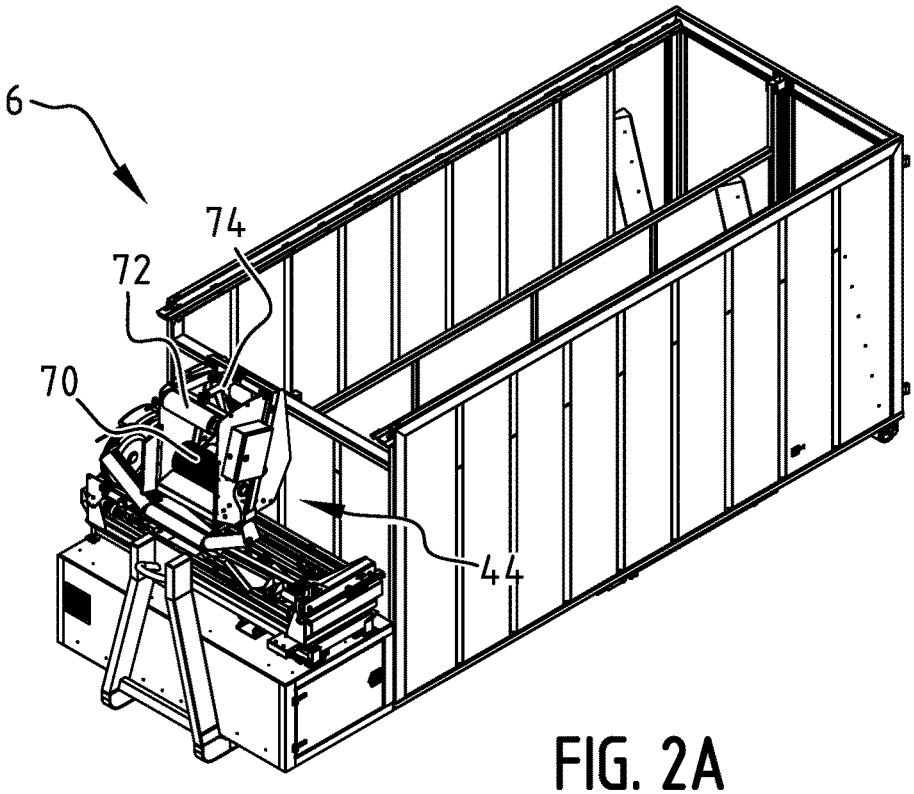
Figure 2B:
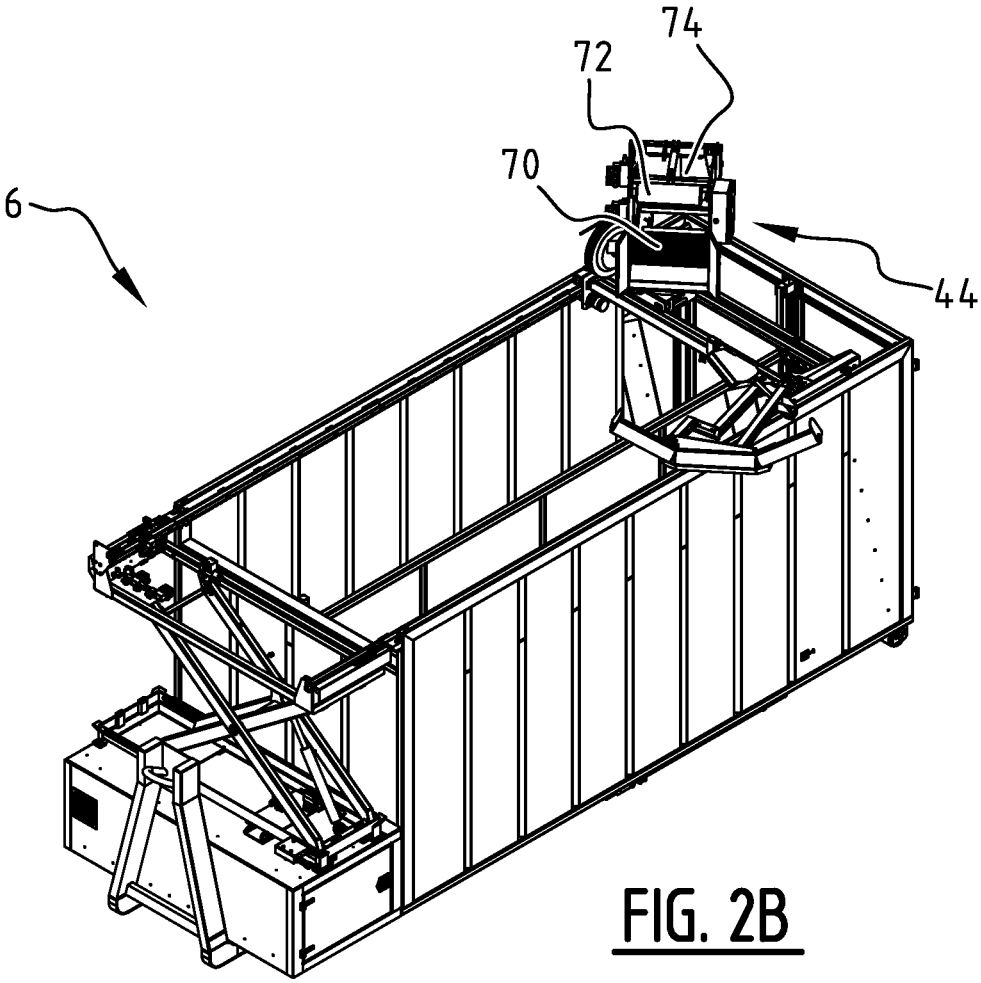
Figure 3A:
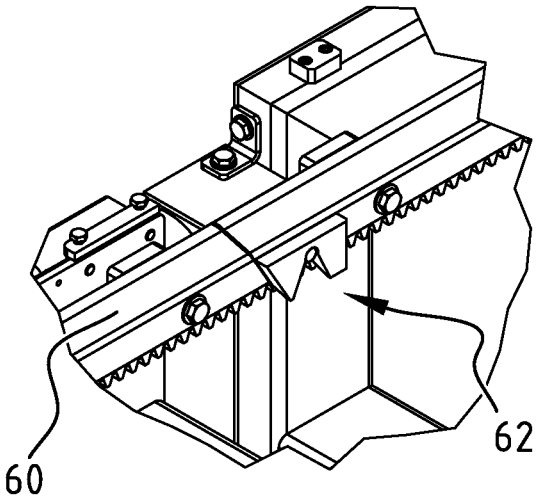
Figure 3B:
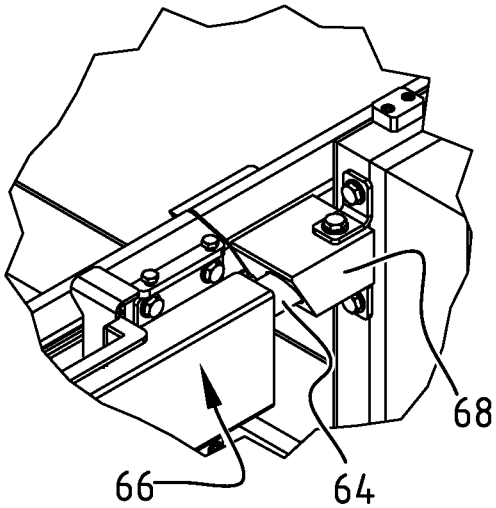

Further advantages, features and details of the invention are elucidated on the basis of preferred embodiments thereof, wherein reference is made to the accompanying drawings, in which:

FIGS. 1A-C show views of a vehicle provided with the retracting device according to the invention;

FIGS. 2A-B show views of the retracting device with container of FIG. 1; and FIGS. 3A-B show details of the coupling applied in the retracting device of FIGS. 1 and 2.

Vehicle 2 (FIGS. 1A-C) moves over a ground surface from which a hose (not shown) has to be picked up. Vehicle 2 is provided with cab 4 in which a driver can sit down and from which vehicle 2 can be steered. In the shown embodiment vehicle 2 is further provided with retracting device 6 and container 8. Container 8 is formed by two long side walls 10, rear wall 12 and front wall 14. Further provided in the shown embodiment is separating wall 16 with which first compartment 18 and second compartment 20 are provided in container 8.

In the shown embodiment retraction drive 22 is placed on lifting mechanism 24 close to front wall 14. In the shown embodiment lifting mechanism 24 is embodied as a scissor mechanism and placed on housing 26, in which components of the drive for retracting device 6 can for instance be placed. Further provided in the shown embodiment is support 30. Lifting mechanism 24 is provided with fixed rotation shaft 32 on a first side and guide 34 on a second side. The scissor mechanism of lifting mechanism 24 is further provided with pivot shaft 36 around which the individual arms of the scissor mechanism are movable. The upper side of lifting mechanism 24 is provided with fixed rotation shaft 38, wherein a guide 40 is provided on the other side. The scissor mechanism of lifting system 24 is realized in effective manner with this set-up. It will be apparent that other designs according to the invention are also possible.

In the shown embodiment movement of lifting system 24 is made possible using lifting cylinder 42. Retraction drive 22 is rotatable relative to frame 46 via rotation shaft 44. Retraction drive 22 is further movable relative to frame 46 in transverse direction of container 8 via guides 48. Hose guide 50 is fixedly connected to frame 46 using rotation shaft 52. During use hose guide 50 is rotated to a position of use using cylinder 54. It will be apparent that a different drive for movement of hose guide 50 is also possible. Further provided on or close to the upper side of container 8 in longitudinal direction at side walls 10 are one or more guides 58 over which frame 46 is displaceable.

Frame 46 is further provided with rail 60 as part of coupling 62 (FIGS. 3A-B). Further provided in the shown embodiment is pawl 64 with pawl drive 66, whereby in position of use pawl 64 is carried into closure 68 arranged on container 8.

In the shown embodiment retraction drive 22 is provided with drive roller 70, a number of pressing rollers 72 and control cylinder 74. A hose can be retracted hereby.

In a transport position (FIG. 2A) lifting system 24 is in a lowermost position. In the shown embodiment retraction drive 22 has herein a straight orientation for the purpose, among others, of saving space. When the retracting process is started up, lifting system 24 is carried upward over a short distance and retraction drive 22 is preferably moved to a side of vehicle 2. In this position a hose can be carried into retraction drive 22. Lifting system 24 is then moved further upward, after which guide rails 60 of lifting system 24 and guide rails 58 on side walls 10 of container 8 are operatively coupled using coupling 62. Frame 46 is further displaceable over container 8 using a gear drive. In this position hose guide 50 is extended by rotation around rotation shaft 52 using cylinder 54, and co-displaces with frame 46 relative to container 8. During use retraction drive 22 is rotated around the rotation shaft so as to enable an optimal guiding. If desired, this rotation is dynamic and is adjusted during use to the current position relative to container 8.

Frame 46 with hose guide 50 moves relative to container 8 during retraction of a hose. In a currently preferred embodiment the speed of frame 46 and hose guide 50 remains as constant as possible relative to a ground surface in order to thereby also keep the pick-up speed of the hose constant. The speed of vehicle 2 is preferably adjusted for this purpose to the movement of frame 46 with guide 50. This is for instance performed by the driver of vehicle 2, who is optionally monitoring the position of the hose during the retracting process between ground surface and retraction drive 22, optionally aided by sensors such as a camera. In another embodiment the speed of vehicle 2 is automatically adjusted by performing an automatic speed correction as a result of the movement of frame 46 and hose guide 50 relative to container 8.

The present invention is by no means limited to the above described preferred embodiments thereof. The rights sought are defined by the following claims, within the scope of which many modifications can be envisaged.

The invention claimed is:

1. A retracting device for retracting a hose, the device comprising:

a frame;

a retraction drive connected to the frame, the retraction drive for retracting the hose;

a coupling configured to couple the frame to a container, and a displacement drive configured to displace the frame relative to the container such that the retracted hose can be placed in the container; and a hose guide configured to guide the hose for retraction via the retraction drive, wherein the hose guide is displaceable in operative connection to the frame;

wherein the frame is further provided with a lifting system configured to move the frame between a transport position and a retracting position.

2. The retracting device as claimed in claim 1, wherein the frame is provided with a guide for displacing the retraction drive relative to the frame.

3. The retracting device as claimed in claim 2, wherein the frame is further provided with a lifting system configured to move the frame between a transport position and a retracting position.

4. The retracting device as claimed in claim 3, wherein the lifting system comprises a scissor mechanism.

5. The retracting device as claimed in claim 1, wherein the lifting system comprises a scissor mechanism.

6. The retracting device as claimed in claim 5, wherein the coupling comprises a locking pawl.

7. The retracting device as claimed in claim 1, wherein the coupling comprises a toothing.

8. The retracting device as claimed in claim 1, wherein the coupling comprises a locking pawl.

9. The retracting device as claimed in claim 1, wherein the hose guide is fixedly connected to the frame.

10. The retracting device as claimed in claim 1, further comprising a rotation mechanism for rotating the retraction drive relative to the frame.

11. The retracting device as claimed in claim 1, wherein the retraction drive comprises:

a drive roller; and a pressing element configured to retract the hose in co-action with the drive roller.

12. A vehicle provided with a retracting device as claimed in claim 1, and a container configured to store the retracted hose.

13. A The vehicle as claimed in claim 12, wherein the container comprises a guide for displacing the frame using the displacement drive.

14. The vehicle as claimed in claim 12, wherein the frame is further provided with a lifting system configured to move the frame between a transport position and a retracting position.

15. The vehicle as claimed in claim 14, wherein the lifting system comprises a scissor mechanism.

16. A method for retracting a hose, comprising:

providing at least one of a retracting device, and vehicle as claimed in claim 1; and retracting the hose with the retracting device.

17. The method as claimed in claim 16, further comprising moving the retracting device from a transport position to a retracting position.

18. The method as claimed in claim 17, further comprising carrying a start of the hose for retraction into the retracting device prior to moving the retracting device to a complete retracting position.

19. The method as claimed in claim 16, further comprising moving the retracting device relative to the container during retraction of the hose such that a predetermined folding pattern is followed, along which the hose is carried into the container.

* * * * *